US009470064B2

(12) United States Patent
Kucera

(10) Patent No.: US 9,470,064 B2
(45) Date of Patent: Oct. 18, 2016

(54) SAFETY VALVE, DOWNHOLE SYSTEM HAVING SAFETY VALVE, AND METHOD

(71) Applicant: Samuel C. Kucera, Tulsa, OK (US)

(72) Inventor: Samuel C. Kucera, Tulsa, OK (US)

(73) Assignee: BAKER HUGHES INCORPORATED, Houston, TX (US)

( * ) Notice: Subject to any disclaimer, the term of this patent is extended or adjusted under 35 U.S.C. 154(b) by 371 days.

(21) Appl. No.: 14/108,934

(22) Filed: Dec. 17, 2013

(65) Prior Publication Data

US 2015/0167423 A1 Jun. 18, 2015

(51) Int. Cl.

| | |
|---|---|
| ***E21B 34/10*** | (2006.01) |
| ***E21B 34/14*** | (2006.01) |
| *E21B 34/00* | (2006.01) |

(52) U.S. Cl.

CPC ..... *E21B 34/14* (2013.01); *E21B 2034/007* (2013.01)

(58) Field of Classification Search

CPC ..... E21B 34/105; E21B 34/10; E21B 34/12; E21B 34/14; E21B 2034/005

USPC ..... 166/332.8, 386, 385

See application file for complete search history.

(56) References Cited

U.S. PATENT DOCUMENTS

| | | | | |
|---|---|---|---|---|
| 3,861,464 | A * | 1/1975 | Boyadjieff | E21B 34/16 166/332.8 |
| 4,201,363 | A | 5/1980 | Arendt et al. | |
| 4,566,540 | A | 1/1986 | Pringle et al. | |
| 4,796,705 | A | 1/1989 | Carmody et al. | |
| 4,796,708 | A | 1/1989 | Lembcke | |
| 4,944,351 | A | 7/1990 | Eriksen et al. | |
| 4,967,845 | A | 11/1990 | Shirk | |
| 4,981,177 | A | 1/1991 | Carmody et al. | |
| 5,199,494 | A | 4/1993 | Williamson, Jr. | |
| 5,329,999 | A | 7/1994 | White et al. | |
| 5,564,675 | A | 10/1996 | Hill, Jr. et al. | |
| 5,875,852 | A | 3/1999 | Floyd et al. | |

(Continued)

FOREIGN PATENT DOCUMENTS

EP 0892148 A2 1/1999

OTHER PUBLICATIONS

Garner, et al., "At the Ready: Subsurface Safety Valves" Oilfield Review, Schlumberger, Winter 2002/2003, www.slb.com, pp. 52-64.

(Continued)

*Primary Examiner* — Kenneth L Thompson
(74) *Attorney, Agent, or Firm* — Cantor Colburn LLP

(57) ABSTRACT

A safety valve including at least one tubular housing having an interior surface. A flow path provided within an interior of the at least one tubular housing. A movable flow path blocking member arranged to block the flow path in a closed condition of the blocking member and open the flow path in an open condition of the blocking member. A first seal bore on the interior surface of the at least one tubular housing. A hydraulic control chamber within a wall of the at least one tubular housing; and, a second seal bore on the interior surface of the at least one tubular housing; wherein the hydraulic control chamber is disposed longitudinally between the first and second seal bores. The second seal bore is disposed longitudinally between the hydraulic control chamber and the movable flow path blocking member. Also included is a method of accommodating a high control pressure wireline insert safety valve within a tubing retrievable safety valve.

19 Claims, 4 Drawing Sheets

(56) References Cited

U.S. PATENT DOCUMENTS

| | | | | |
|---|---|---|---|---|
| 6,059,041 | A | 5/2000 | Scott | |
| 6,260,850 | B1 | 7/2001 | Beall et al. | |
| 6,352,118 | B1 * | 3/2002 | Dickson | E21B 34/106 166/322 |
| 6,684,950 | B2 * | 2/2004 | Patel | E21B 47/1025 166/120 |
| 7,055,607 | B2 * | 6/2006 | Jacob | E21B 33/10 166/126 |
| 7,562,712 | B2 * | 7/2009 | Cho | E21B 23/04 166/319 |
| 7,624,792 | B2 * | 12/2009 | Wright | E21B 33/06 137/68.11 |
| 7,694,740 | B2 | 4/2010 | Mailand et al. | |
| 7,779,925 | B2 * | 8/2010 | Jacob | E21B 33/10 166/192 |
| 8,037,938 | B2 | 10/2011 | Jardim De Azevedo et al. | |
| 9,051,811 | B2 * | 6/2015 | Bussear | E21B 34/10 |
| 2009/0205832 | A1 | 8/2009 | Jean-Luc | |
| 2012/0199367 | A1 | 8/2012 | Bouldin et al. | |

OTHER PUBLICATIONS

International Search Report and Written Opinion, International Application No. PCT/US2014/065145, Date of Mailing Feb. 25, 2015, Korean Intellectual Property Officec, International Search Report 5 pages; Written Opinion 11 pages.

* cited by examiner

SAFETY VALVE, DOWNHOLE SYSTEM HAVING SAFETY VALVE, AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. A production tubing string is typically run thousands of feet into a well bore. Generally, when running a tubing string downhole, it is desirable, and in some cases required, to include a safety valve on the tubing string. The safety valve typically has a fail safe design whereby the valve will automatically close to prevent production from flowing through the tubing, should, for example, the surface production equipment be damaged or malfunction.

Should the safety valve become inoperable, the safety valve may be retrieved to surface by removing the tubing string, as described hereinafter. The tubing retrievable surface controlled subsurface safety valve ("TRSV") is attachable to production tubing string and includes a flapper pivotally mountable on the lower end of the safety valve assembly by a flapper pin. A torsion spring is provided to bias the flapper in the closed position to prevent fluid flow through the tubing string. When fully closed the flapper seals off the inner diameter of the safety valve assembly preventing fluid flow therethrough. A flow tube is provided above the flapper to open and close the flapper. The flow tube is adapted to be movable axially within the safety valve assembly. When the flapper is closed, the flow tube is in its uppermost position; when the flow tube is in its lowermost position, the lower end of the flow tube operates to extend through and pivotally open the flapper. When the flow tube is in its lowermost position and the flapper is open, fluid communication through the safety valve assembly is allowed. A rod piston contacts the flow tube to move the flow tube. The rod piston is located in a hydraulic piston chamber within the TRSV. The upper end of the chamber is in fluid communication, via a control line, with a hydraulic fluid source and pump at the surface. Seals are provided such that when sufficient control fluid (e.g. hydraulic fluid) pressure is supplied from surface, the rod piston moves downwardly in the chamber, thus forcing the flow tube downwardly through the flapper to open the valve. When the control fluid pressure is removed, the rod piston and flow tube move upwardly allowing the biasing spring to move the flapper and thus the valve, to the closed position.

If the TRSV becomes inoperable or malfunctions due to the buildup of materials such as paraffin, fines, and the like on the components downhole, e.g., such that the flapper does not fully close or does not fully open, it is known to replace the TRSV by retrieving the safety valve assembly to surface by pulling the entire tubing string from the well and replacing the safety valve assembly with a new assembly, and then rerunning the safety valve and the tubing string back into the well. Because of the length of time and expense required for such a procedure, it is known to run a replacement safety valve downhole within the TRSV. These replacement safety valves are run downhole via a wireline, and thus often referred to as wireline insertable safety valves ("WISV"). Before inserting the WISV into the TRSV assembly, however, two operations are performed. First, the TRSV is locked in its open position (i.e., the flapper must be maintained in the open position); and second, fluid communication is established from the existing control fluid line to the interior of the TRSV, thus providing control fluid (e.g. hydraulic fluid) to the WISV. Lockout tools perform the former function; communication tools perform the latter. When it is desired to lock the safety valve assembly in its open position, the lockout tool is lowered through the tubing string and into the TRSV. The lockout tool is then actuated to lock the valve mechanism (e.g. the flapper) of the TRSV in the open position.

Before inserting the WISV, communication is established between the hydraulic chamber of the TRSV and the internal diameter of the TRSV. The communication tool is utilized to provide fluid communication between the inner diameter of the TRSV and the hydraulic chamber, so that the hydraulic control line from surface can be utilized to operate the WISV. Once communication has been established with the hydraulic chamber, the WISV is run downhole. The WISV may resemble a miniature version of the TRSV assembly. The WISV is placed within the inner diameter of the TRSV assembly. The WISV includes an upper seal above the communication flow passageway and a lower seal below the flapper and at a bottom sub, and the control line to the TRSV is used to actuate the valve mechanism of the WISV. More specifically, the upper and lower seals allow control fluid from the control line to communicate with the hydraulic chamber and piston of the WISV in order to actuate the valve of the WISV between the open and closed positions. Once the WISV is in place, the wireline is removed and the tubing string placed on production.

The art would be receptive to more robust downhole systems incorporating TRSV and WISV, and improved methods for operating downhole in varying and extreme conditions experienced by such downhole systems.

SUMMARY

A safety valve including at least one tubular housing having an interior surface, a flow path provided within an interior of the at least one tubular housing; a movable flow path blocking member arranged to block the flow path in a closed condition of the blocking member and open the flow path in an open condition of the blocking member; a first seal bore on the interior surface of the at least one tubular housing; a hydraulic control chamber within a wall of the at least one tubular housing; and, a second seal bore on the interior surface of the at least one tubular housing; wherein the hydraulic control chamber is disposed longitudinally between the first and second seal bores, and the second seal bore is disposed longitudinally between the hydraulic control chamber and the movable flow path blocking member.

A method of accommodating a high control pressure wireline insert safety valve within a tubing retrievable safety valve, the method including: sealing a first seal of the wireline insert safety valve within a first seal bore in the tubing retrievable safety valve; and sealing a second seal of the wireline insert safety valve within a second seal bore in the tubing retrievable safety valve; wherein the second seal bore is disposed between the first seal bore and a movable flow path blocking member of the tubing retrievable safety valve.

BRIEF DESCRIPTION OF THE DRAWINGS

Referring now to the drawings wherein like elements are numbered alike in the several Figures.

DETAILED DESCRIPTION

Figure 1:
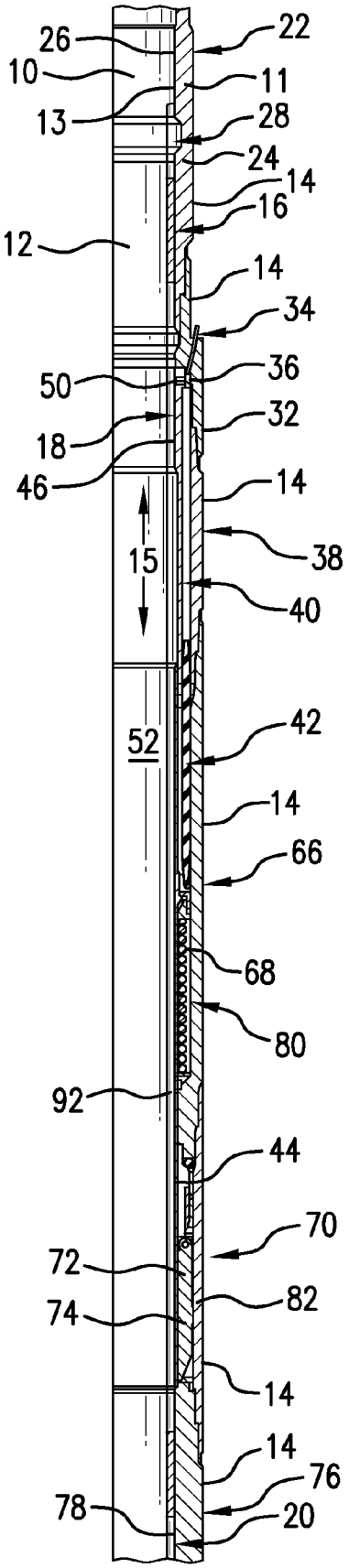
FIG. 1 shows a half cross-sectional view of an exemplary embodiment of a tubing retrievable surface controlled subsurface safety valve ("TRSV")

As shown in FIG. 1, an exemplary embodiment of the tubing retrievable surface controlled subsurface safety valve ("TRSV") 10 includes a tubular housing 12 having a plurality of housing units 14. A wall 11 of the tubular housing 12 includes an interior surface 13. A flow path 15, which may direct fluids in either an uphole or downhole direction as indicated, is provided within an interior 52 of the tubular housing 12. As will be further described below, the housing 12 includes at least first, second, and third seal bores 16, 18, 20. The seal bores 16, 18, 20 in the downhole system 100 (FIGS. 2 and 3) are used to isolate zones or to facilitate the operation of accessory or auxiliary equipment. The seal bores 16, 18, 20 can be accessed by a tool on a string that is placed into position by means of wireline services or coiled tubing. The tool includes external seals that interact with the seal bores 16, 18, 20 to achieve a fluid tight seal. The seal bores 16, 18, 20 must be free of, or at least substantially free of, surface irregularities, voids, and cracks that would prevent a proper seal with the external seals on the inserted tool. Thus, the seal bores 16, 18, 20 may be prepared by polishing to the required consistency. Sensors can be used to measure for surface irregularities. If necessary, repair fluids such as epoxy resin or liquid metal may be spread onto the seal bores 16, 18, 20, worked into any voids or cracks, and then the seal bores 16, 18, 20 may be re-polished so that the seal bores 16, 18, 20 will seal with external seals on an inserted tool. Thus, the seal bores 16, 18, 20 are distinguished from other portions of the interior surface 13 of the TRSV 10.

Figure 2:
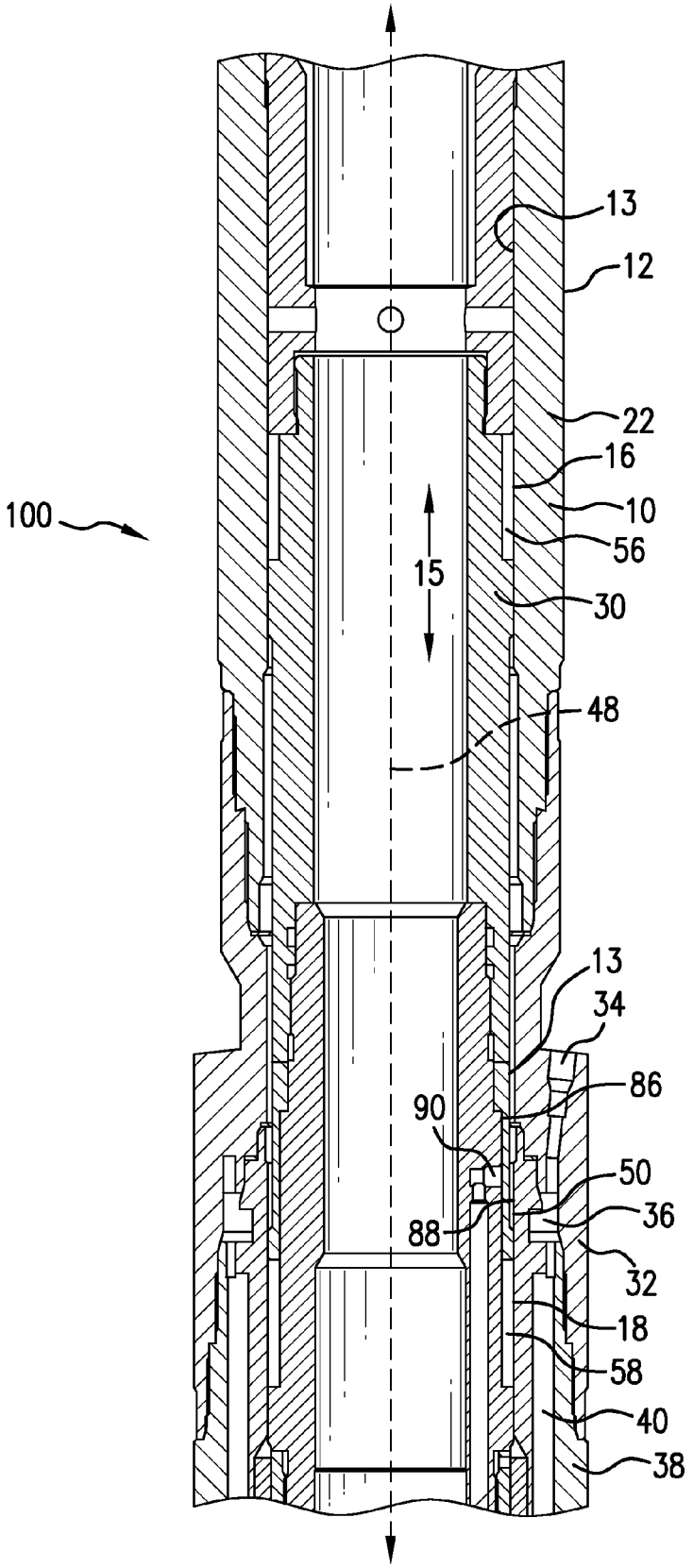
FIG. 2 shows a cross-sectional view of a downhole system including the TRSV of FIG. 1 with an exemplary embodiment of a wireline insert safety valve ("WISV") inserted therein.
Figure 3:
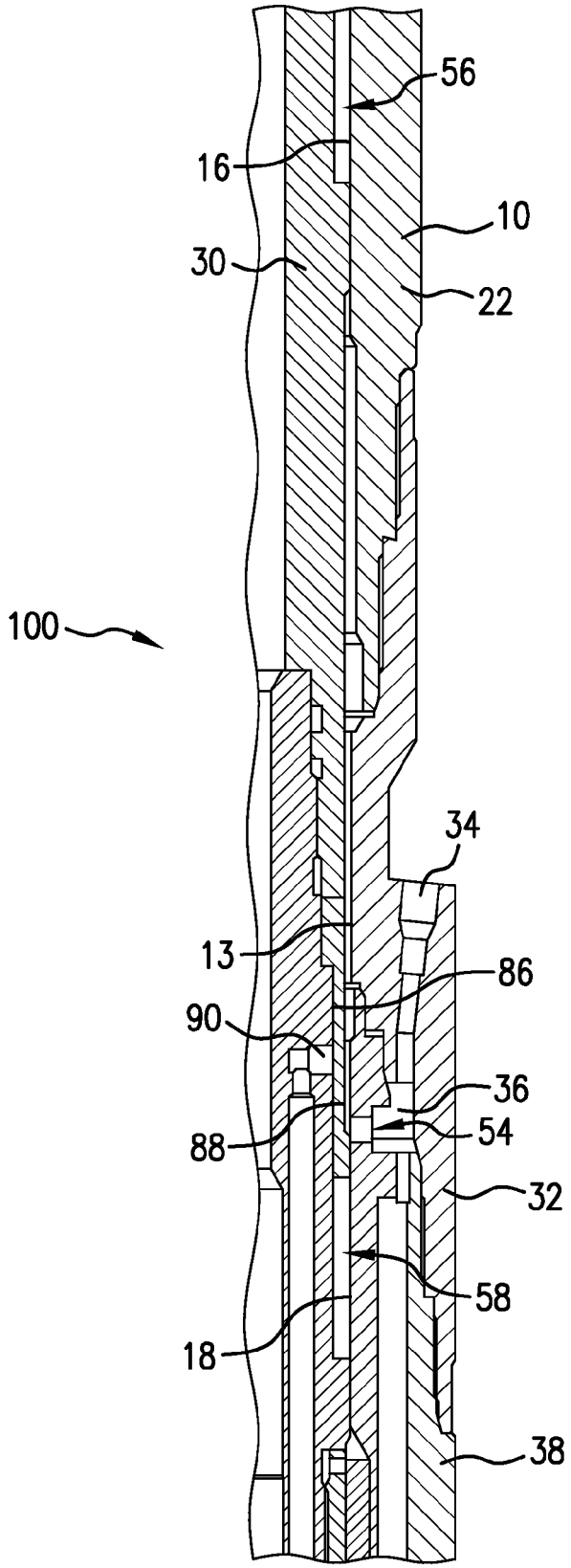
FIG. 3 shows a half cross-sectional view of the downhole system of FIG. 2, with the TRSV communicated; and, FIG. 4 shows a side perspective view of an exemplary embodiment of a communication tool according to the prior art.

The housing units 14 of the housing 12 include a nipple adaptor 22 having a relatively thick tubular wall 24, an interior surface 26 of which includes a lock profile 28 and the first seal bore 16 for accessory tools. One such accessory tool is a wireline insert safety valve ("WISV") 30, an exemplary embodiment of which is shown in FIGS. 2 and 3 as part of the exemplary downhole system 100. The WISV 30 may include substantially the same internal components, although on a smaller scale, as the TRSV 10 for performing the functions of a safety valve. The first seal bore 16 is an upper seal bore for the WISV 30. While the seal bore 16 is referred to as a "first" or "upper" seal bore, it should be understood that the downhole system 100 may include other seal bores (not shown) that are uphole of the seal bore 16, and therefore the adjectives "first" and "upper" are merely used to distinguish the seal bore 16 from other seal bores 18, 20 specifically described herein within the downhole system 100.

Figure 4:
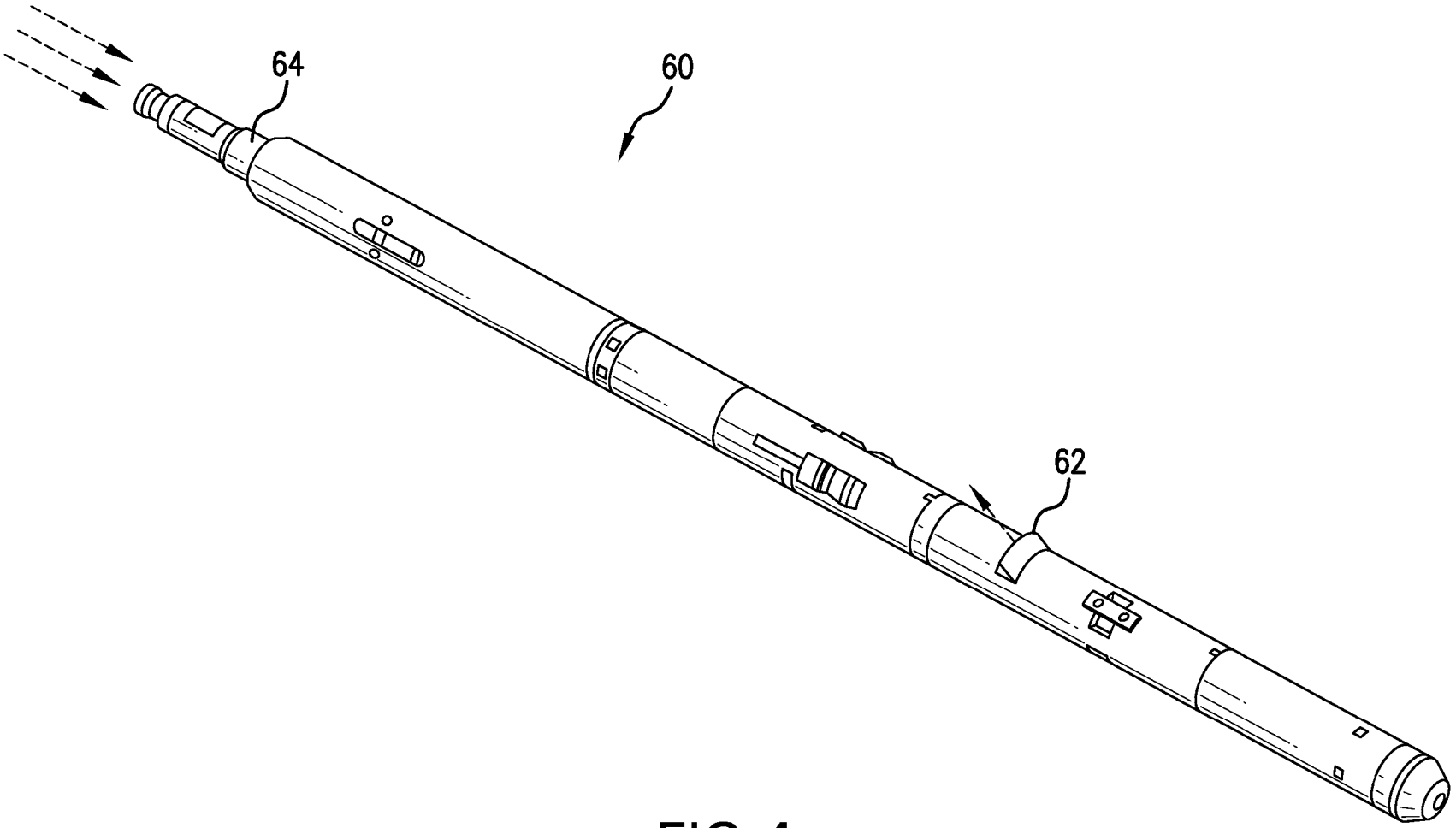
FIG. 4 PRIOR ART

The housing 12 further includes a control housing 32, an uphole portion of which is attached to a downhole portion of the nipple adapter 22. The control housing 32 includes a hydraulic communication port 34 for conveying hydraulic control pressure from the wellhead or other remote location or chamber to the TRSV 10. The hydraulic communication port 34 may be attached to a hydraulic control line (not shown). The control housing 32 further includes a control chamber 36, which may be annular or otherwise, and may also be external to the valve. An extended control housing 38 attached to the control housing 32 further incudes a piston bore 40 to hold a control piston 42 which actuates a flow tube 44. The piston 42 may alternatively be integral with the flow tube 44. The extended control housing 38 further includes the second seal bore 18 on an interior surface 46 of the extended control housing 38. The second seal bore 18 may be positioned radially inward of the piston bore 40. More particularly, the second seal bore 18 may be positioned radially inward of an uphole portion of the piston bore 40 such that a cross-section taken perpendicular to a longitudinal axis 48 (FIG. 2) of the TRSV 10 would include the second seal bore 18, extended control housing 38, uphole portion of the piston bore 40, and control housing 32. Prior to the WISV 30 being inserted into the TRSV 10, such as if it is determined that the TRSV 10 is inoperable or malfunctioning, the TRSV 10 is "communicated" such as by piercing an interior wall 50 of the extended control housing 38 at a location 54 (FIG. 3) corresponding to the control chamber 36 of the control housing 32 to communicate the hydraulic communication port 34 with the interior 52 of the TRSV 10. FIG. 2 illustrates the TRSV 10 as not communicated, for illustrative purposes only. Thus, when the WISV 30 is inserted within the TRSV 10 and sealed therein to the first and second seal bores 16, 18, as will be further described below, surface-controlled hydraulic pressure to the WISV 30 is provided. A recess may be added in the control housing 32 that is communicated at the communication location 54 to prevent any metal shards from damaging the second seal 58 on the WISV 30. The downhole system 100 may utilize any manner of communication that involves compromising the interior wall 50 of the control housing 32 and/or extended control housing 38 containing the piston bore 40, such as by employing a communication tool which can activate a cutting device. One exemplary embodiment of a communication tool 60 is shown in FIG. 4 and includes a retractable cutting device 62, which can be extended radially outward upon longitudinal movement of a central prong 64. Further details regarding the communication tool 60 may be had from a review of U.S. Pat. No. 7,918,280, which is herein incorporated by reference in its entirety.

Additional housing units 14 in the housing 12 of the TRSV 10 include, but are not limited to, a housing 66 covering a power spring 68 and a housing 70 covering a movable flow path blocking member 72, such as a flapper 74. While the movable flow path blocking member 72 of the TRSV 10 is illustrated as a flapper-type safety valve, alternatively a ball-seat type of valve, or other types of valves may be incorporated in the TRSV 10. The movable operating components including the piston 42 and power spring 68 may be replaced by other or additional components to operate the movable flow path blocking member 72.

The housing 12 of the TRSV 10 also includes a bottom sub 76, which contains the third seal bore 20 along an interior surface 78 of the tubular bottom sub 76. The third seal bore 20 may be referred to herein as a lower seal bore of the TRSV 10. This lower or third seal bore 20, in conjunction with the upper or first seal bore 16, provide the seal bores 16, 20 for sealing therein a separation sleeve 92 (shown for illustrative purposes in FIG. 1) to completely isolate interior surfaces of the safety valve from the well, which can be desirable when harsh chemical treatments are being conducted, for example. Additionally, if the valve fails, the TRSV 10 can be communicated and a standard WISV (not shown) can be inserted into the lock profile 28 of the TRSV 10, and sealed off at the first and third seal bores 16, 20. This essentially turns the interior 52 of the TRSV 10 (from the first seal bore 16 to the third seal bore 20 and between WISV and the TRSV 10) into a control chamber for the WISV.

For purposes of manufacturing and assembly, the nipple adapter 22, control housing 32, extended control housing 38, housing 66 covering the power spring 68, housing 70 covering the flapper 74, and bottom sub 76 are separate housing units 14 combinable to form the housing 12, however any two or more adjacent combinations of the above housing units 14 may alternatively be integrally combined. It should further be understood that each housing unit 14 connects to an adjacent uphole and downhole housing unit 14 via suitable connectors and/or connection features, such as, but not limited to, nested fittings, set screws, welds, screw threads, etc. Each housing unit 14 is tubular in shape surrounding the longitudinal axis 48 of the TRSV 10 such that the interior 52 of the housing 12 of the TRSV 10 provides the flow path 15 for extraction of natural resources or injection of fluids.

A surface-controlled subsurface safety valve ("SCSSV") (wireline WISV 30 or tubing retrievable TRSV 10) must be able to fail into the closed position; that is to say, the power spring 68 must be able to lift the flow tube 44 (and any other moving parts) against the hydrostatic force of the hydraulic control fluid from the surface. Therefore, a SCSSV must be able to tolerate a control pressure strong enough to not only overcome the force of the tubing pressure (pressure within the WISV 30 or TRSV 10) against the bottom of the control piston, such as piston 42 of TRSV 10, but must also be able to compress the power spring, such as power spring 68 of TRSV 10. Due to these strong forces against the deflection of piston, the necessary hydraulic control pressure of a SCSSV is higher than the tubing pressure caused by the well. For deepset valves in high pressure wells, the internal pressure caused by this hydraulic control pressure acting upon thin housing sections, such as thin sections 80, 82 of the power spring housing 66 and flapper housing 70, can be a limiting design factor as to whether the TRSV can accommodate a WISV. At a certain point, a WISV cannot be accommodated that can operate with the control pressure limitation imposed by the burst rating of the spring and flapper housings 66, 70. That is, there are design limitations imposed upon the WISV 30 due to the imposed limit on hydraulic control pressure that TRSV housings can be exposed to.

Since a typical WISV interfaces with the TRSV 10 in such a manner that turns substantially the entire interior 52 of the TRSV 10 into a control chamber for the WISV, from the first seal bore 16 to the third seal bore 20, thin sections 80, 82 in the housings 66, 70 must be designed to accommodate not only tubing pressure, but also control chamber pressure. Normal SCSSV design ends up rating WISV 30 to lower control chamber ratings than the TRSV's control chamber is capable of withstanding, while designing housings to a pressure intermediate to well pressure and TRSV control chamber pressure. This balancing act works at setting depths of up to 4,000 or 5,000 feet, but for TRSV 10 set deeper than that, serious design trade-offs start to occur in order to keep the TRSV 10 compatible with a WISV 30 that can overcome tubing pressure.

Thus, the exemplary TRSV 10 disclosed herein incorporates the second seal bore 18 just downhole of the control chamber communication area 54, so that the WISV 30 can seal into the thick housing 12 at that point. In particular, the wall 11 of the housing 12 at the second seal bore 18 includes a wall thickness of at least the extended control housing 38, and may additionally include a wall thickness of the control housing 32. In either case, since this area of the housing 12 is already designed to accommodate hydraulic control pressure, having the second seal bore 18 positioned at this area limits the control chamber of the WISV 30 to the area between the first and second seals 56, 58. This removes the thin sections 80, 82 of housings 66, 70 from the volume exposed to hydraulic control pressure for the WISV 30. That is, the second seal bore 18 in the extended control housing 38 limits the TRSV involvement with the WISV control chamber to the nipple adapter 22 and the control housings 32, 38. Since the nipple adapter 22 is thick, it is better able to withstand elevated control chamber pressures, and the control housings 32, 38 are able to withstand full control chamber pressure by design. This will allow WISV 30 to accept higher operating pressures, and therefore stronger power springs. With a stronger power spring, the WISV 30 can be set in deeper wells. Additionally, this will remove a limiting load case from TRSV design.

An exemplary embodiment of the WISV 30 for use in the downhole system 100 shown in FIGS. 2 and 3 includes at least the first seal 56 sealable within the first seal bore 16 in the nipple adapter 22 and the second seal 58 sealable within the second seal bore 18 in the extended control housing 38. The space, such as an annular space, between the interior surface 13 of the TRSV 10, an exterior surface 86 of the WISV 30 and the first and second seals 56, 58 forms a control chamber 88 for the WISV 30. Because the second seal bore 18 is located uphole of the flow tube 44, power spring 68, and flapper 74, the control chamber 88 is also longitudinally displaced from and located uphole of the flow tube 44 and the thin sections 80, 82 of the power spring and flapper housings 66, 70. The control chamber 88 is radially inward of the nipple adapter 22, control housing 32, and extended control housing 38, all of which may be designed to have wall thicknesses greater than wall thicknesses of the power spring and flapper housings 66, 70. The WISV 30 includes a hydraulic communication port 90 disposed between the first and second seals 56, 58 for receiving hydraulic control pressure from the control chamber 88. The WISV 30 also includes the necessary equipment for functioning as a safety valve including, but not limited to the movable flow path blocking member and movable operating components for the movable flow path blocking member, details of which can be garnered from the description of similar components in the TRSV 10.

A method of accommodating an ultra high control pressure WISV 30 in a TRSV 10 includes securing the movable flow path blocking member 72 in an open condition as shown in FIG. 1, communicating the TRSV 10 as shown in FIG. 3 such as through use of a communication tool 60 as shown in FIG. 4, running the WISV 30 within the TRSV 10, and sealing the first seal 56 within the first seal bore 16 and sealing the second seal 58 within the second seal bore 18, as further shown in FIG. 3. The control chamber 88 for the WISV 30 (formed by the exterior surface 86 of the WISV 30, the interior surface 13 of the TRSV 10, and the first and second seals 56, 58) is sealed from a portion of the interior of the housing 12 at a location of movable operating components 73, which include the piston 42 and flapper 74, of the movable flow path blocking member 72.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A safety valve comprising:

at least one tubular housing having an interior surface, a flow path provided within an interior of the at least one tubular housing;

a movable flow path blocking member arranged to block the flow path in a closed condition of the blocking member and open the flow path in an open condition of the blocking member;

a first seal bore on the interior surface of the at least one tubular housing;

a hydraulic control chamber within a wall of the at least one tubular housing; and, a second seal bore on the interior surface of the at least one tubular housing;

wherein the hydraulic control chamber is disposed longitudinally between the first and second seal bores, and the second seal bore is disposed longitudinally between the hydraulic control chamber and the movable flow path blocking member, and the safety valve is a tubing retrievable surface controlled subsurface safety valve.

2. The safety valve of claim 1, wherein the wall of the at least one tubular housing is communicated to provide fluid access between the hydraulic control chamber and the interior of the at least one tubular housing.

3. The safety valve of claim 1, wherein the first seal bore is provided on a nipple adapter of the at least one tubular housing.

4. The safety valve of claim 3, wherein the second seal bore is provided on a housing portion of the at least one tubular housing, the housing portion disposed between the nipple adapter and a housing portion for a movable operating component of the movable flow path blocking member.

5. The safety valve of claim 1 further comprising a flow tube longitudinally movable within the interior of the at least one tubular housing, wherein the second seal bore is disposed longitudinally between the first seal bore and the flow tube.

6. The safety valve of claim 1, further comprising a third seal bore disposed downhole of the movable flow path blocking member, wherein the third seal bore and at least one of the first and second seal bores are configured to sealingly receive a separation sleeve within the interior of the at least one tubular housing.

7. The safety valve of claim 6 wherein the third seal bore is located within a housing portion disposed longitudinally past the movable flow path blocking member of the safety valve.

8. The safety valve of claim 1, wherein a first wall thickness of the at least one tubular housing between the first and second seal bores is larger than a second wall thickness of the at least one tubular housing at a location enclosing movable operating components of the movable flow path blocking member.

9. A safety valve comprising:

at least one tubular housing having an interior surface, a flow path provided within an interior of the at least one tubular housing;

a movable flow path blocking member arranged to block the flow path in a closed condition of the blocking member and open the flow path in an open condition of the blocking member;

a first seal bore on the interior surface of the at least one tubular housing;

a hydraulic control chamber within a wall of the at least one tubular housing; and, a second seal bore on the interior surface of the at least one tubular housing;

wherein the hydraulic control chamber is disposed longitudinally between the first and second seal bores, and the second seal bore is disposed longitudinally between the hydraulic control chamber and the movable flow path blocking member, and the first and second seal bores are polished bores configured to sealingly receive first and second seals of an accessory tool inserted within the at least one tubular housing.

10. A safety valve comprising:

at least one tubular housing having an interior surface, a flow path provided within an interior of the at least one tubular housing;

a movable flow path blocking member arranged to block the flow path in a closed condition of the blocking member and open the flow path in an open condition of the blocking member;

a first seal bore on the interior surface of the at least one tubular housing;

a hydraulic control chamber within a wall of the at least one tubular housing; and, a second seal bore on the interior surface of the at least one tubular housing;

wherein the hydraulic control chamber is disposed longitudinally between the first and second seal bores, and the second seal bore is disposed longitudinally between the hydraulic control chamber and the movable flow path blocking member, and the safety valve is configured to receive a wireline insert safety valve sealed upon the first and second seal bores.

11. A downhole system comprising:

a safety valve including:

at least one tubular housing having an interior surface, a flow path provided within an interior of the at least one tubular housing;

a movable flow path blocking member arranged to block the flow path in a closed condition of the blocking member and open the flow path in an open condition of the blocking member;

a first seal bore on the interior surface of the at least one tubular housing;

a hydraulic control chamber within a wall of the at least one tubular housing; and, a second seal bore on the interior surface of the at least one tubular housing;

wherein the hydraulic control chamber is disposed longitudinally between the first and second seal bores, and the second seal bore is disposed longitudinally between the hydraulic control chamber and the movable flow path blocking member; and, a wireline insert safety valve disposed within the at least one tubular housing, the wireline insert safety valve including a first seal sealed on the first seal bore and a second seal sealed on the second seal bore.

12. The downhole system of claim 11, wherein the interior surface of the at least one tubular housing is communicated to allow communication between the hydraulic control chamber and a hydraulic communication port of the wireline insert safety valve.

13. The downhole system of claim 11, wherein a control chamber for the wireline insert safety valve is formed between the interior surface of the at least one tubular housing, an exterior surface of the wireline insert safety valve, and the first and second seals.

14. The downhole system of claim 13, wherein the control chamber for the wireline insert safety valve is sealed from a portion of the interior of the at least one tubular housing at a location of movable operating components of the movable flow path blocking member.

15. A method of accommodating a high control pressure wireline insert safety valve within a tubing retrievable safety valve, the method including:

sealing a first seal of the wireline insert safety valve within a first seal bore in the tubing retrievable safety valve; and sealing a second seal of the wireline insert safety valve within a second seal bore in the tubing retrievable safety valve;

wherein the second seal bore is disposed between the first seal bore and a movable flow path blocking member of the tubing retrievable safety valve.

16. The method of claim 15 further comprising communicating a hydraulic control chamber within a wall of the tubing retrievable safety valve between the first and second seal bores prior to sealing the first and second seals within the first and second seal bores.

17. The method of claim 16 further comprising providing hydraulic control pressure from the hydraulic control chamber to a control chamber of the wireline insert safety valve between an exterior surface of the wireline insert safety valve, an interior surface of the tubing retrievable safety valve, the first seal and the second seal.

18. The method of claim 15 further comprising, prior to sealing the first and second seals within the first and second seal bores, running a separation sleeve within the tubing retrievable safety valve and sealing the separation sleeve at the first seal bore and a third seal bore, the movable flow path blocking member disposed between the third seal bore and the second seal bore.

19. The method of claim 15 wherein a wall thickness of a control chamber for the wireline insert safety valve, between the wireline insert safety valve and the tubing retrievable safety valve, is greater than a wall thickness of a portion of the housing containing movable operating components of the movable flow path blocking member.

* * * * *